US005864205A

United States Patent [19]

Dworsky

[11] Patent Number: 5,864,205

[45] Date of Patent: Jan. 26, 1999

[54] GRIDDED SPACER ASSEMBLY FOR A FIELD EMISSION DISPLAY

[75] Inventor: Lawrence N. Dworsky, Scottsdale, Ariz.

[73] Assignee: Motorola Inc., Schaumburg, Ill.

[21] Appl. No.: 752,977

[22] Filed: Dec. 2, 1996

[51] Int. Cl.[6] ..... H01J 1/62; H01J 63/04; H01J 1/88; H01J 19/42

[52] U.S. Cl. ..... 313/495; 313/238; 313/281; 313/292

[58] Field of Search ..... 313/495, 496, 313/292, 497, 238, 268, 287; 220/445

[56] References Cited

U.S. PATENT DOCUMENTS 4,341,980 7/1982 Noguchi et al. ..... 313/495
5,506,467 4/1996 Nishimura et al. ..... 313/496
5,589,731 12/1996 Fahlen et al. ..... 313/495

*Primary Examiner*—Frank G. Font
*Assistant Examiner*—Mack Haynes
*Attorney, Agent, or Firm*—Jasper W. Dockrey

[57] ABSTRACT

A gridded spacer assembly (130, 230) for a field emission display (100, 200) includes a plurality of spacers (135, 235), a focusing grid (132, 232) having a plurality of spacer apertures (133) in which the spacers (135, 235) are disposed and to which the spacers (135, 235) are affixed adjacent their lower end, a stabilization grid (138, 238) having a plurality of spacer apertures (137) in registration with the spacer apertures (133) of the focusing grid (132, 232), the spacers (135, 235) being disposed therein and affixed thereto adjacent their upper end, the focusing grid (132, 232) and the stabilization grid (138, 238) having a plurality of focusing apertures (139) for collimating and focusing a beam of electrons (150).

9 Claims, 3 Drawing Sheets

110

120

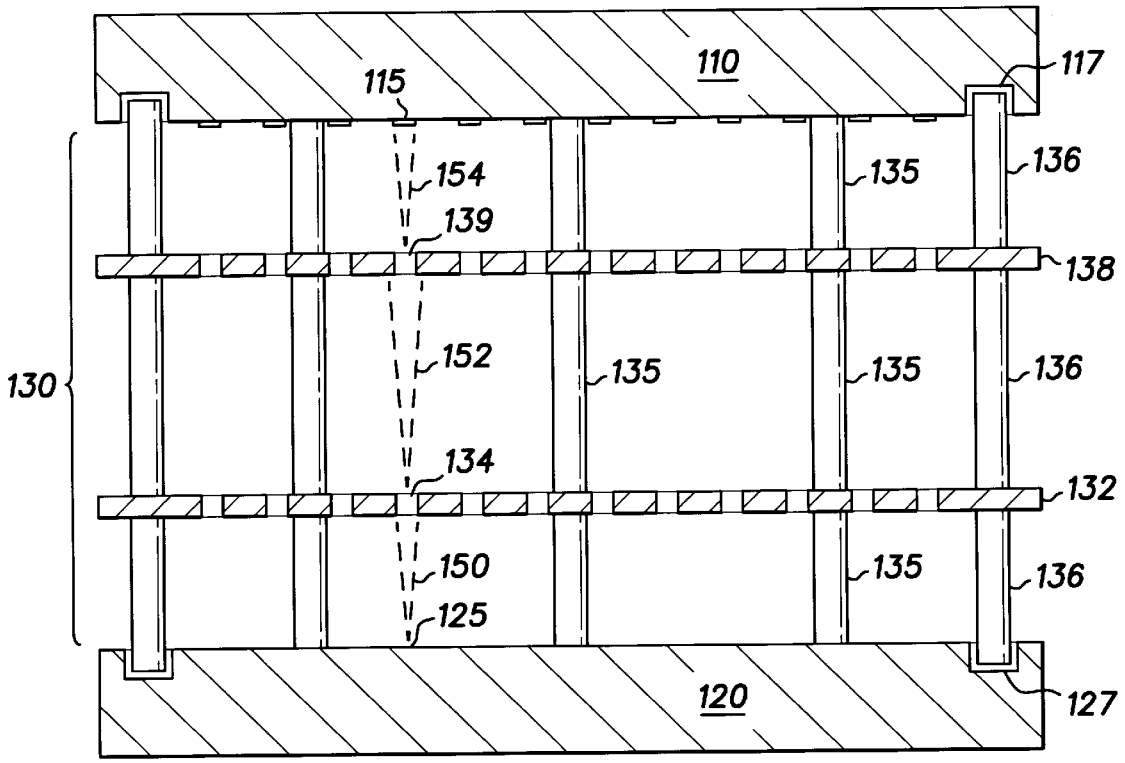
100 FIG. 4
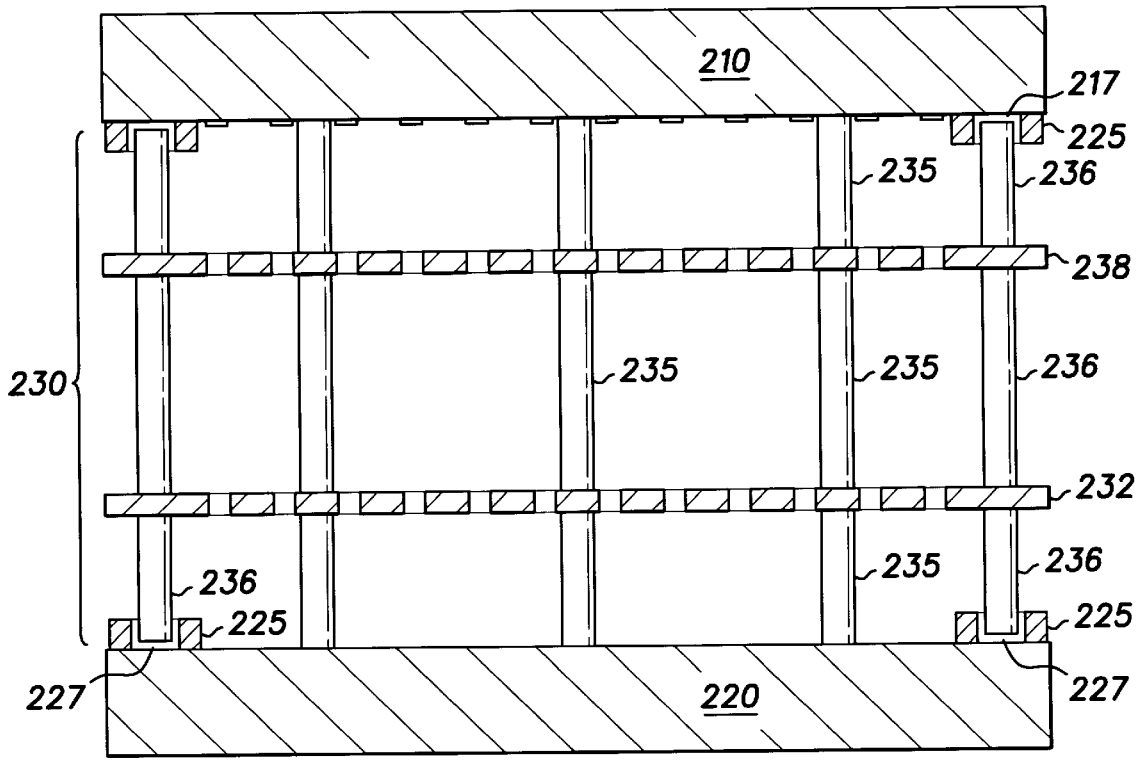
200 FIG. 5

GRIDDED SPACER ASSEMBLY FOR A FIELD EMISSION DISPLAY

FIELD OF THE INVENTION

The present invention pertains to the area of field emission displays and more specifically to a spacer assembly for a field emission display.

BACKGROUND OF THE INVENTION

Field emission displays are known in the art. They include an envelope structure having an evacuated interspace region between two display plates. Electrons travel across the interspace region from a cathode plate (also known as a cathode), which includes electron-emitting devices, to an anode plate (also known as an anode), which includes deposits of a light-emitting material, or "phosphors". Typically, the pressure within the evacuated interspace region between the cathode and anode plates is on the order of $10^{-6}$ Torr.

Spacers for field emission displays are also known in the art. The cathode plate and anode plate are thin in order to provide low display weight and reduce package thickness. If the display area is small, such as in a 2.54 cm diagonal display, and a typical sheet of glass having a thickness of about 0.1 cm is utilized for the plates, the display will not collapse or bow significantly. However, as the display area increases the thin plates are not sufficient to withstand the pressure differential in order to prevent collapse or bowing upon evacuation of the interspace region. For example, a screen having a 76.2 cm diagonal will have several tons of atmospheric force exerted upon it. As a result of this tremendous pressure, spacers play an essential role in large area, light-weight displays. Spacers are structures being incorporated between the anode and the cathode plate. The spacers, in conjunction with the thin, lightweight, plates, support the atmospheric pressure, allowing the display area to be increased with little or no increase in plate thickness.

Several schemes have been proposed to provide display spacers. These spacers and methods have several drawbacks. Methods for fabricating spacers which employ screen printing, stencil printing, or the use of glass balls suffer from the inability to provide a spacer having a sufficiently high aspect ratio (the ratio of spacer height to spacer thickness). Prior art methods which include aligning each individual spacer require repeated alignment steps and the adhesion of each spacer so that they will remain upright during subsequent packaging and sealing steps. These requirements are time consuming and add complexity.

Spacers for a field emission flat panel display must be invisible to the viewer. That is, they must be narrow enough to fit between the pixels of the display. Typically, the anode is coated with phosphor dots which are surrounded by a "black surround" material. This black surround material serves to increase the contrast ratio of the display and prevent the scattering of light between pixels. If the spacers are narrow enough to fit in the black surround area, then they will be invisible to the viewer. As an example, a 26.4 cm VGA display is easily designed to allow about 150 micrometers wide black surround stripes in one axis. Allowing for various tolerances, this means that spacers which are less than 100 micrometers wide would easily fit in the available space. It may be shown, for example, that glass rods having a diameters of 75 micrometers placed in a square pattern having a pitch of about 0.5 cm would satisfy both the invisibility and the structural strength requirements. The height of the spacer and, consequently, the aspect ratio is determined by the operating voltage. For a display designed to operate at 5,000 volts, a distance of about 1 millimeter is required between the anode and cathode plates of the display in order to prevent arc break down. The resulting aspect ratio is therefore about 10:1, which tends to make the spacers difficult to position and place accurately.

Accordingly, there exists a need for an apparatus and method for incorporating spacers into a field emission display which provides high aspect ratio spacers and ease of spacer placement and alignment.

BRIEF DESCRIPTION OF THE DRAWINGS

Referring to the drawings:

FIG. 4 is a side elevational view of the field emission display of FIG. 1; and FIG. 5 is a side elevation view, similar to that of FIG. 4, of another embodiment of a field emission display in accordance with the present invention.

DESCRIPTION OF THE PREFERRED EMBODIMENT

Figure 1:
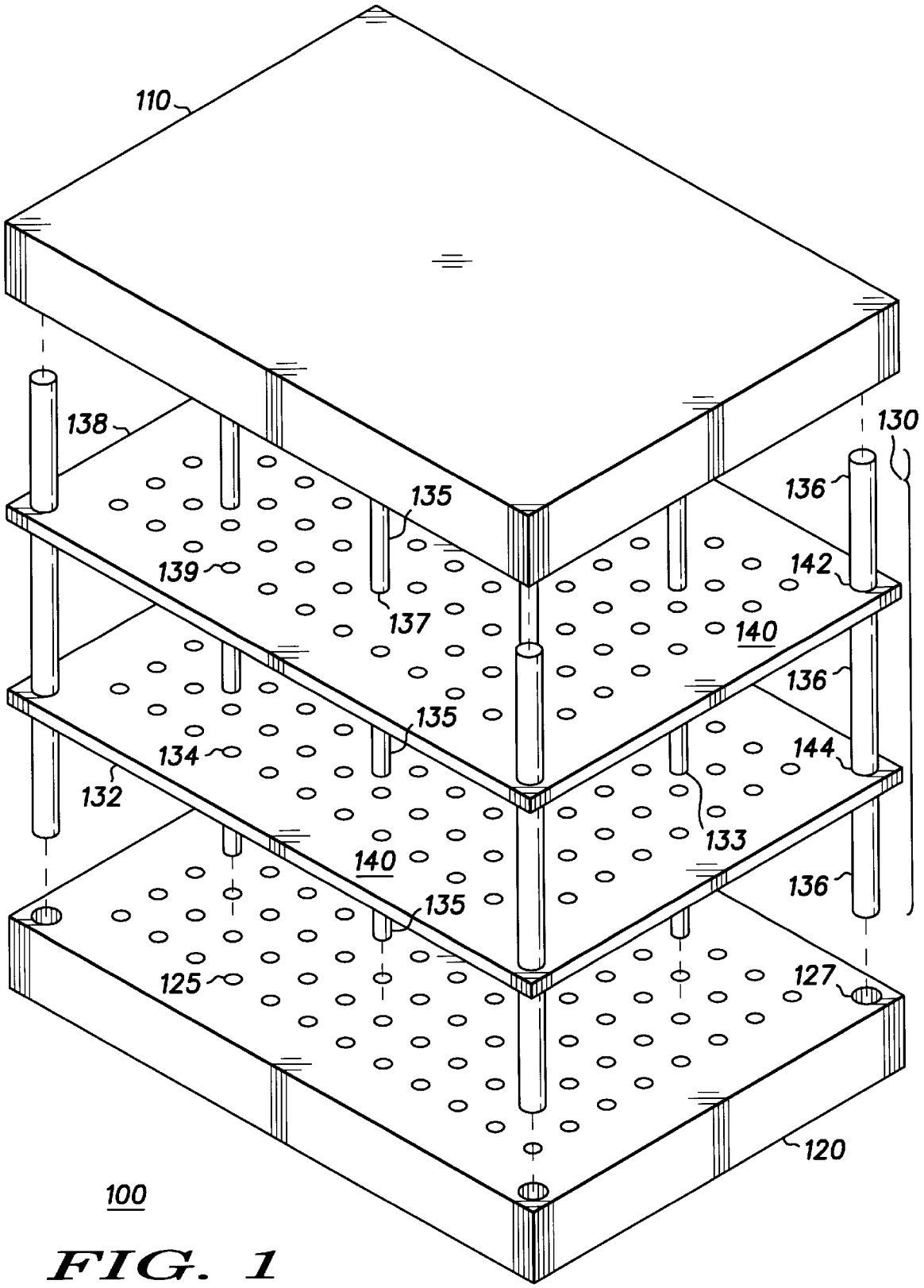
FIG. 1 is an isometric, exploded view of an embodiment of a field emission display in accordance with the present invention.
Figure 2:
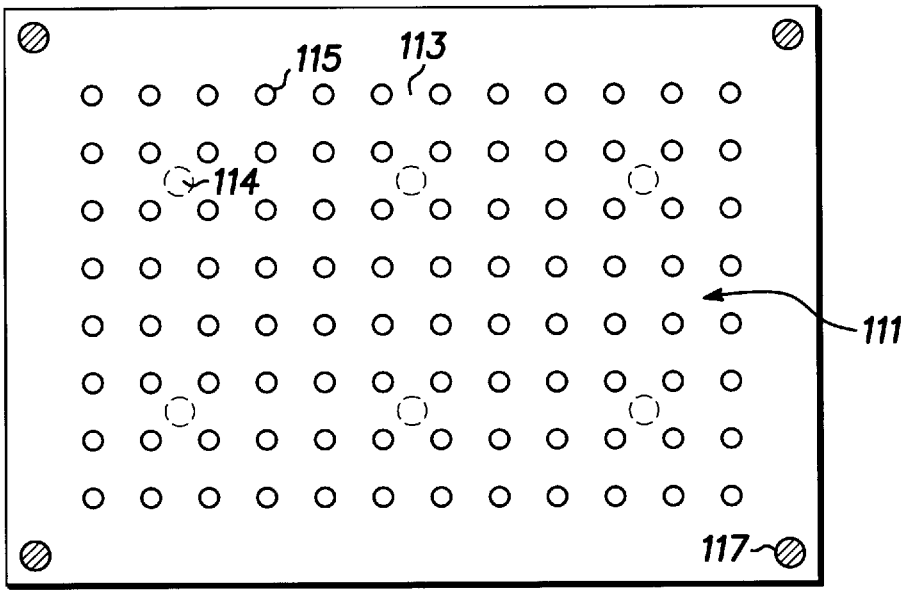
FIG. 2 is a bottom plan view of an anode plate of the field emission display of FIG. 1.
Figure 3:
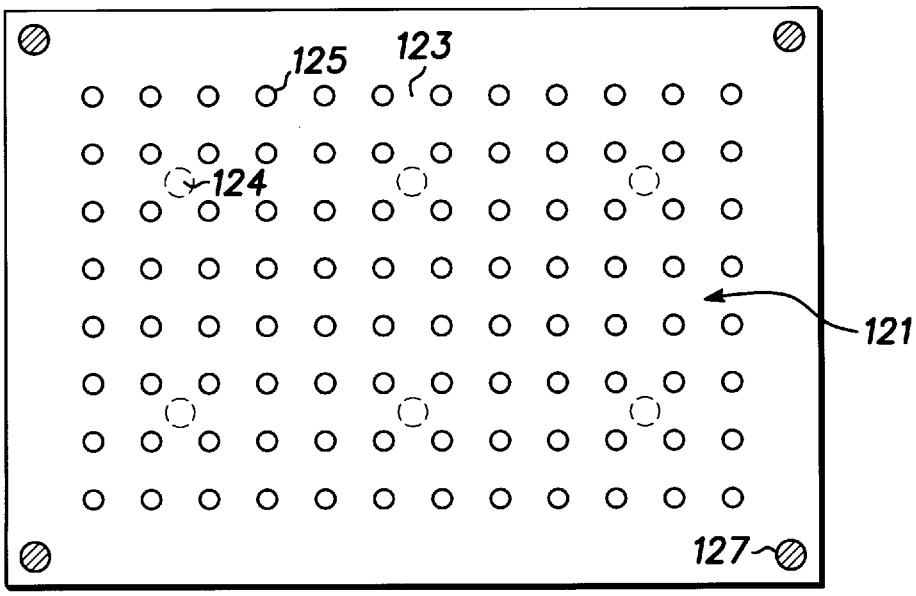
FIG. 3 is a top plan view of a cathode plate of the field emission display of FIG. 1.

Referring now to FIGS. 1–3, there are depicted an isometric, exploded view (FIG. 1) of a field emission display (FED) 100, a bottom plan view (FIG. 2) of an anode plate 110 of FED 100, and a top plan view (FIG. 3) of a cathode plate 120 of FED 100, in accordance with the present invention. FED 100 further includes a gridded spacer assembly 130, in accordance with the present invention, which is positioned between cathode plate 120 and anode plate 110. Cathode plate 120 includes an array of emission pixels 125 formed on its inner surface. Each of emission pixels 125 includes one or more field emitting structures, such as Spindt tips, which are known to one skilled in the art. Cathode plate 120 also includes four alignment receptacles 127, one at each corner of the periphery of the inner surface of cathode plate 120. Gridded spacer assembly 130 includes a plurality of spacers 135 oriented generally perpendicularly with respect to the inner surfaces of cathode plate 120 and anode plate 110, and parallel to one another. The first ends of spacers 135 are in abutting engagement with the inner surface of cathode plate 120 at portions of a region 123 between emission pixels 125, as indicated by dashed circles 124 in FIG. 3. Anode plate 110 includes a plurality of cathodoluminescent deposits 115 which are in registration with emission pixels 125 for receiving electrons emitted therefrom. The second ends of spacers 135 are in abutting engagement with the inner surface of anode plate 110 at portions of a region 113 between cathodoluminescent deposits 115, as indicated by dashed circles 114 in FIG. 2. The first ends or the second ends of spacers 135, or both, may have deposited thereon a compliant, deformable material to ease dimensional tolerances among spacers 135. Gridded spacer assembly 130 further includes a focusing grid 132 and a stabilization grid 138, both of which are oriented generally perpendicularly to spacers 135 and fixedly attached thereto, and which are parallel to anode plate 110 and cathode plate 120. Focusing grid 132 has a plurality of spacer apertures 133 formed therein for receiving, one each, spacers 135.

Spacers 135 are fixedly attached to focusing grid 132 by using a bonding agent, such as an adhesive, glass frit, and solder. Focusing grid 132 further includes a plurality of focusing apertures 134 which are disposed in registration, one each, with emission pixels 125. Focusing grid 132 is conductive. In this particular embodiment focusing grid 132 includes a glass substrate having a coating of a conductive material, such as aluminum. Focusing grid 132 may have deposited thereon a gettering material 140 for collecting gaseous contaminants within the display. Suitable gettering materials include zirconium/vanadium/iron alloy, zirconium metal, or materials having aluminum or titanium. These types of materials are available typically in powdered form and may be adhered to focusing grid 132 by, for example, admixing a low-melting-point alloy with the gettering material, such as an indium alloy. Alternatively, the gettering material may be applied by electrophoretic deposition or screen printing. Focusing grid 132 is also operably connected to a DC voltage source (not shown) for applying a suitable voltage thereto. The size of focusing apertures 134 and the magnitude of the voltage applied to focusing grid 132 are designed to adequately collimate and focus beams of electrons emitted from emission pixels 125, as will be described in greater detail with reference to FIG. 4. Focusing grid 132 is attached to spacers 135 along the height thereof, at a distance from cathode plate 120 approximately equal to one tenth the length of each of spacers 135. Stabilization grid 138 is configured similarly to focusing grid 132. There may be variation with respect to the diameter of the focusing apertures, as will be described presently. Stabilization grid 138 is attached to spacers 135 along the height thereof, at a distance from cathode plate 120 approximately equal to nine tenths the length of each of spacers 135. Stabilization grid 138 has a plurality of spacer apertures 137 formed therein for receiving, one each, spacers 135. Spacer apertures 137 are in registration with spacer apertures 133 of focusing grid 132 thereby defining a plurality of paired, aligned spacer apertures. Spacer apertures 137, 133 are sized and shaped to receive spacers 135. In this particular embodiment, this includes forming spacer apertures 137, 133 to have diameters slightly greater than the diameters of spacers 135. Each of spacers 135 is placed through one of these pairs of spacer apertures thereby configuring spacers 135 perpendicularly with respect to both focusing grid 132 and stabilization grid 138. Spacers 135 are fixedly attached to stabilization grid 138 by using a bonding agent, such as an adhesive, glass frit, and solder. Stabilization grid 138 further includes a plurality of focusing apertures 139, which are in registration with focusing apertures 134 of focusing grid 132. Stabilization grid 138 provides stability to gridded spacer assembly 130. It also focuses electron beams onto cathodoluminescent deposits 115. The size of each of focusing apertures 139 is slightly less than the size of its corresponding one of cathodoluminescent deposits 115, so that stabilization grid 138 physically blocks electrons which would otherwise strike anode plate 110 outside cathodoluminescent deposits 115. To further facilitate proper focusing of the electron beams, focusing apertures 139 may also be shaped to replicate the shape of cathodoluminescent deposits 115. To bleed off impinging charge, stabilization grid 138 is conductive. In this particular embodiment stabilization grid 138 includes a glass substrate having a coating of a conductive material, such as aluminum. Stabilization grid 138 may have deposited thereon, in the same manner as described with reference to focusing grid 132, gettering material 140 for collecting gaseous contaminants within the display. In general, different materials may be used to make the elements of gridded spacer assembly 130 so long as they exhibit compatible expansion rates during thermal processing. This can be accomplished by using materials having equal, or nearly equal, thermal expansion coefficients. Moreover, the thermal expansion coefficients of cathode plate 120 and anode plate 110 are equal to, or nearly equal to, that of gridded spacer assembly 130. Spacers 135 may include rods made by extruding a glass having a suitable thermal expansion coefficient. To bleed off charge impinging upon spacers 135 during the operation of FED 100, a highly resistive coating may be formed on the surfaces of spacers 135. A suitable material includes amorphous silicon. Alternatively, the surface of spacers 135 can be modified to slightly increase surface conductivity, such as by doping the surface with a suitable dopant. Spacers having shapes other than rods may be employed, so long as the invisibility and structural requirements are met. Spacer apertures 133, 137 and focusing apertures 134, 139 may be made by standard processing technologies, such as photolithographic patterning and chemical etching, to provide the predetermined pattern in a metal or glass substrate. If glass is employed, a metal coating is formed on the glass subsequent aperture formation. As further indicated in FIGS. 2 and 3, cathodoluminescent deposits 115 and region 113 together define an active region 111 of anode plate 110, and emission pixels 125 and region 123 together define an active region 121 of cathode plate 120. In the periphery of anode plate 110, outside active region 111, are formed four alignment receptacles 117, which may be formed by a drilling operation. In the periphery of cathode plate 120, outside active region 121, are formed four alignment receptacles 127, which may also be formed by a drilling operation. Received by alignment receptacles 117, 127 are the opposing ends of four alignment members 136 which are configured similarly to spacers 135, within gridded spacer assembly 130. Alignment members 136 are held within aligned pairs of alignment apertures 142, 144 formed within stabilization grid 138 and focusing grid 132, respectively, at their peripheries. Alignment members 136 are fixedly attached to focusing grid 132 and stabilization grid 138 at alignment apertures 144, 142 in a manner similar to that discussed with reference to spacers 135. Alignment members 136 may include structures similar to spacers 135. In this particular embodiment, the height of alignment members 136 is greater than that of spacers 135. The opposing ends of alignment members 136 are disposed in alignment receptacles 117, 127. The configuration of alignment members 136 within alignment receptacles 117, 127 is such that alignment members 136 do not perform a weight bearing function. This ensures that spacers 135 uniformly make contact with cathode plate 120 and anode plate 110. More than four alignment members may be employed. Other alignment receptacle configurations may be used as well, one example of which will be described with greater detail with respect to FIG. 5.

Gridded spacer assembly 130 provides a rigid, stable, unitary structure which can be aligned and accurately placed in one alignment step onto one of the display plates. This is done, for example, by aligning gridded spacer assembly 130 above cathode plate 120, and then lowering gridded spacer assembly 130 onto cathode plate 120 so that alignment members 136 are received by alignment receptacles 127. Alignment receptacles 127, and all the elements of gridded spacer assembly 130, are configured so that this single placement step achieves the predetermined registration of focusing apertures 134, 139 with emission pixels 125. The location of spacers 135 is precisely determined by the location of spacer apertures 133, 137, which are in turn precisely determined by the patterning technique, such as photolithographic techniques, used to make them. In this manner, only one precise alignment step of gridded spacer assembly 130 is required, thereby obviating multiple precise alignment steps of individual spacers. An additional benefit is that gridded spacer assembly 130 will retain its positioning during subsequent packaging and display fabrication steps, thereby obviating the need for additional holding fixtures. Thereafter, anode plate 110 is lowered onto gridded spacer assembly 130 so that the upper ends of alignment members 136 are received within alignment receptacles 127, thereby providing registration between cathodoluminescent deposits 115 (FIG. 2) and focusing apertures 139 and also thereby positioning the upper ends of spacers 135 within region 113, between cathodoluminescent deposits 115. A frame (not shown) is disposed between cathode plate 120 and anode plate 110, surrounding gridded spacer assembly 130, to form an evacuateable envelope containing gridded spacer assembly 130.

Referring now to FIG. 4, there is depicted a side elevational view of FED 100 of FIG. 1 and further illustrating a beam of electrons 150 being emitted from one of emission pixels 125. In this particular embodiment, each of emission pixels 125 includes a plurality of Spindt tip, or cone-shaped, field emitters, known to one skilled in the art. More than one emitter is used for each of emission pixels 125 to provide the necessary current at the desired voltage and to provide statistical redundancy to the structure. The pattern of the electron beam emitted from one tip emitter is, to a first approximation, a Gaussian distribution centered directly above the tip. The width of the distribution at the screen, given no focusing grid or stabilization grid, depends upon the operating emitter voltage, the voltage at anode plate 110, the distance between anode plate 110 and cathode plate 120, and other variables. Typically, this distribution is unacceptably larger than the size of the cathodoluminescent deposit. The problem tends to be exacerbated by the inclusion of multiple tips within each of emission pixels 125. Focusing grid 132 and stabilization grid 138 reduce the size of beam of electrons 150 to provide a focused electron beam 154 which is received only by the predetermined one of cathodoluminescent deposits 115. By properly designing the size of focusing apertures 134, the thickness of focusing grid 132, and the voltage applied to focusing grid 132, it is possible to produce a more focused, narrower electron beam 152 emanating therefrom. The process includes a combination of columnation of the beam and electron absorption. Stabilization grid 138 is operably connected to a voltage source (not shown) and is maintained at a potential equal to, or nearly equal to, the potential at anode plate 110, which may be about 5000 volts. When held at the potential of anode plate 110, stabilization grid 138 functions as a "shadow mask", thereby providing a small additional amount of columnation of electron beam 152. This is achieved principally by the absorption of electrons which would otherwise strike outside the predetermined one of cathodoluminescent deposits 115, which is in registration with the given one of focusing apertures 139 in stabilization grid 138. An additional benefit derived from maintaining stabilization grid 138 at the potential of anode plate 110 is that there is thereby established an equipotential region between anode plate 110 and stabilization grid 138. This eliminates the delamination of material from anode plate 110 due to the material's propensity to delaminate in the presence of a high electric field, thereby reducing potentially damaging loose particle generation within FED 100 during its operation. The effects of gaseous contaminants and ions are mitigated by focusing grid 132. Focusing grid 132 provides mechanical protection to the structures comprising cathode plate 120; it acts as a shield intercepting any accelerating ions due to arcs or discharges that occur during the operation of FED 100. The distance between cathode plate 120 and anode plate 110 is adequate to maintain the predetermined potential difference therebetween. For a potential difference of about 5000 volts, this distance is about 1.25 millimeters (???). The overall layout pattern, and total number, of spacers 135 will depend upon factors such as the thickness of the glass substrates comprising anode plate 110 and cathode plate 120. For example, if borosilicate glass substrates, each having a thickness of about 1.1 mm, are employed, an adequate arrangement includes an array of spacers 135 (each spacer having a diameter of about 75 micrometers) having a pitch of about 12 millimeters. In this particular embodiment, the thickness of each of focusing grid 132 and stabilization grid 138 is about 50 micrometers, and focusing apertures 134, 139 are circular, each having a diameter of about 300 micrometers. In general, the exact design of gridded spacer assembly 130, including specification of the aforementioned dimensions, requires careful electrostatic and structural modeling of the entire system.

Referring now to FIG. 5, there is depicted a side elevational view, similar to that of FIG. 4, of a field emission display (FED) 200 in accordance with the present invention. FED 200 includes a cathode plate 220, an anode plate 210, and a gridded spacer assembly 230, including a plurality of spacers 235. In this particular embodiment, four alignment members 236 are received, at one end, within four alignment receptacles 217 on anode plate 210 and, at the opposed end, within four alignment receptacles 227 on cathode plate 220. Alignment receptacles 217, 227 are defined by eight ring-shaped members 225 affixed to anode plate 210 and cathode plate 220, at the corners thereof. Ring-shaped members 225 include a solid structure having a depression designed to closely surround an end of alignment members 236. Ring-shaped members 225 are configured so that when the ends of alignment members 236 are disposed therein, gridded spacer assembly 230 is immovably positioned between, and aligned with, cathode plate 220 and anode plate 210, in the manner described with reference to FIGS. 1–4. Ring-shaped members 225 may be made of, for example, ceramic, and are affixed to cathode plate 220 and anode plate 210 by using a suitable bonding agent, such as an adhesive, a glass frit, or a solder. Alignment members 236 do not extend across the entire depth of alignment receptacles 217, 227 and are shorter than spacers 235 so that alignment members 236 are precluded from bearing weight, thereby ensuring the uniform loading of spacers 235.

While I have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

I claim:

1. A gridded spacer assembly for a field emission display comprising:

a plurality of spacers being parallel to one another and having first and second ends; and a focusing grid defining a plurality of spacer apertures, the plurality of spacers being disposed one each in the plurality of spacer apertures of the focusing grid, the focusing grid being affixed to the plurality of spacer at a location intermediate the first and second ends of the plurality of spacers, the first ends of the plurality of spacers being disposed in a common plane, the focusing grid further defining a plurality of focusing apertures designed to collimate and focus beams of electrons passing therethrough.

2. A gridded spacer assembly as claimed in claim 1 further including a stabilization grid defining a plurality of spacer apertures in registration with the plurality of spacer apertures of the focusing grid, the plurality of spacers being disposed one each in the plurality of spacer apertures of the stabilization grid, the stabilization grid being affixed to the plurality of spacers at a second distance from the first ends of the plurality of spacers, the second distance being greater than the first distance, the second ends of the plurality of spacers being disposed in a second common plane, the stabilization grid further defining a plurality of focusing apertures being in registration with the plurality of focusing apertures of the focusing grid and being designed to focus beams of electrons passing therethrough.

3. A gridded spacer assembly as claimed in claim 2 wherein the stabilization grid has a gettering material disposed thereon for collecting gaseous contaminants.

4. A gridded spacer assembly as claimed in claim 1 wherein the plurality of spacers are made from glass, the focusing grid is made from glass having a coating of a conductive material, and the stabilization grid is made from glass having a coating of a conductive material.

5. A gridded spacer assembly as claimed in claim 1 wherein the focusing grid has a gettering material disposed thereon for collecting gaseous contaminants.

6. A gridded spacer assembly as claimed in claim 1 wherein the focusing grid has a periphery and further defines a plurality of alignment apertures disposed at the periphery of the focusing grid and wherein the stabilization grid further defines a plurality of alignment apertures disposed in registration with the plurality of alignment apertures of the focusing grid to define a plurality of paired alignment apertures, the gridded spacer assembly further including a plurality of alignment members disposed one each in the plurality of paired alignment apertures, the plurality of alignment members being fixedly connected to the focusing grid and the stabilization grid.

7. A field emission display comprising:

a cathode plate having a plurality of emission pixels;

an anode plate having a plurality of cathodoluminescent deposits being in registration with the plurality of emission pixels, the anode plate being spaced from the cathode plate to define an interspace region therebetween; and a gridded spacer assembly disposed within the interspace region and including a plurality of spacers having first and second ends, the first ends disposed in a common plane defined by the cathode plate, the second ends disposed in a common plane defined by the anode plate, the gridded spacer assembly further including a focusing grid disposed a first distance from the first ends of the plurality of spacers and defining a plurality of spacer apertures, the spacers being disposed one each in the plurality of spacer apertures of the focusing grid and being fixedly attached thereto at a location intermediate the first and second ends of the plurality of spacers, the focusing grid further including a plurality of focusing apertures being in registration one each with the plurality of emission pixels.

8. A field emission display as claimed in claim 7 further including a stabilization grid defining a plurality of spacer apertures in registration with the plurality of spacer apertures of the focusing grid, the plurality of spacers being disposed one each in the plurality of spacer apertures of the stabilization grid, the stabilization grid being affixed to the plurality of spacers at a second distance from the first ends of the plurality of spacers, the second distance being greater than the first distance, the stabilization grid further defining a plurality of focusing apertures being in registration with the plurality of focusing apertures of the focusing grid and being designed to focus beams of electrons passing therethrough.

9. A field emission display as claimed in claim 8 wherein the focusing grid of the gridded spacer assembly has a periphery and defines a plurality of alignment apertures at the periphery and wherein the stabilization grid further defines a plurality of alignment apertures disposed in registration with the plurality of alignment apertures of the focusing grid to define a plurality of paired alignment apertures, the gridded spacer assembly further including a plurality of alignment members having ends and being disposed one each in the plurality of paired alignment apertures, the plurality of alignment members being fixedly connected to the focusing grid and the stabilization grid, the cathode plate and the anode plate having a plurality of alignment receptacles being in registration with the plurality of alignment members and being designed to receive the ends of the plurality of alignment members, the plurality of emission pixels and the plurality of cathodoluminescent deposits being in registration with the plurality of focusing apertures of the focusing grid and with the plurality of focusing apertures of the stabilization grid.

* * * * *

UNITED STATES PATENT AND TRADEMARK OFFICE

CERTIFICATE OF CORRECTION

PATENT NO. : 5,864,205
DATED : January 26, 1999
INVENTOR(S) : Dworsky

It is certified that error appears in the above-identified patent and that said Letters Patent is hereby corrected as shown below:

In column 6, claim 1, line 66, replace "spacer" with --spacers--.

Signed and Sealed this

Twenty-ninth Day of June, 1999

*Attest:*

Q. TODD DICKINSON

*Attesting Officer*

*Acting Commissioner of Patents and Trademarks*